US005150478A

United States Patent [19]

Niedajkasza et al.

[11] Patent Number: 5,150,478

[45] Date of Patent: Sep. 29, 1992

[54] METHOD FOR THE PRODUCTION OF MODULABLE GARMENTS

[75] Inventors: Mauricette Niedajkasza, 58, Avenue du Rouquet, 33700 Merignac; Bruno Niedajkasza; Catherine Niedajkasza, both of Merignac, all of France

[73] Assignee: Mauricette Niedajkasza, Merignac, France

[21] Appl. No.: 601,806

[22] PCT Filed: May 3, 1989

[86] PCT No.: PCT/FR89/00216

§ 371 Date: Oct. 31, 1990

§ 102(e) Date: Oct. 31, 1990

[87] PCT Pub. No.: WO89/10706

PCT Pub. Date: Nov. 16, 1989

[30] Foreign Application Priority Data

May 3, 1988 [FR] France ..... 88 05932

[51] Int. Cl.[5] ..... A41D 27/00

[52] U.S. Cl. ..... 2/243 R; 2/243 B

[58] Field of Search ..... 2/243 R, 243 B

[56] References Cited

U.S. PATENT DOCUMENTS 3,010,169 11/1961 Carpinella ..... 24/107
3,662,404 5/1972 Schinker ..... 2/243
3,746,602 7/1973 Caroli et al. ..... 2/243 R

FOREIGN PATENT DOCUMENTS 2098869 3/1972 France .

*Primary Examiner*—Werner H. Schroeder
*Assistant Examiner*—Gloria Hale
*Attorney, Agent, or Firm*—Armstrong, Nikaido, Marmelstein, Kubovcik & Murray

[57] ABSTRACT

Method for producing a modulable garment by assembling pieces (1) having assembling lines (2) reproducing a single diamond-shaped basic design. The pieces are provided with fastening means (3) such as press-studs placed along the assembling lines and are so arranged that the diamond-shaped pieces have their large diagonal (d) oriented vertically. The top and bottom parts of the garment are each formed by a row of four pieces defining four diamond shapes assembled by their angles situated at the ends of the small diagonals.

8 Claims, 2 Drawing Sheets

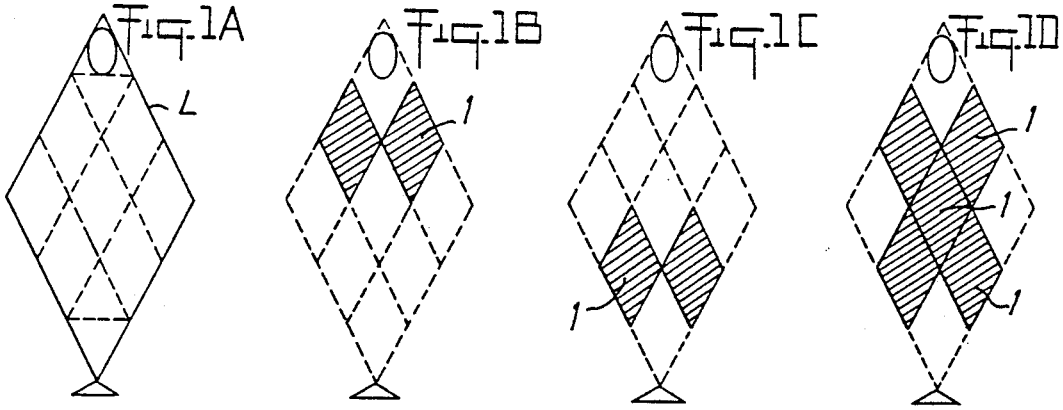
Fig. 1A
L
Fig. 1B
1
Fig. 1C
1
Fig. 1D
1
1
1
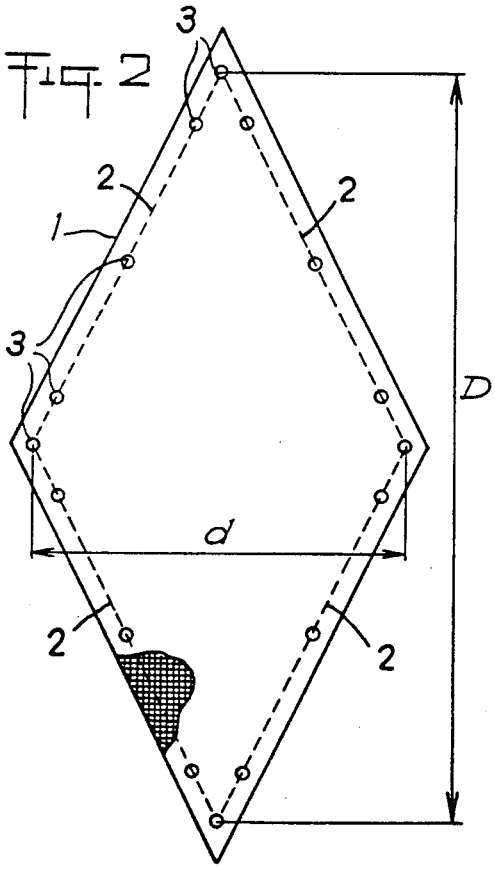
Fig. 2
3
2
2
1
3
D
d
2
2
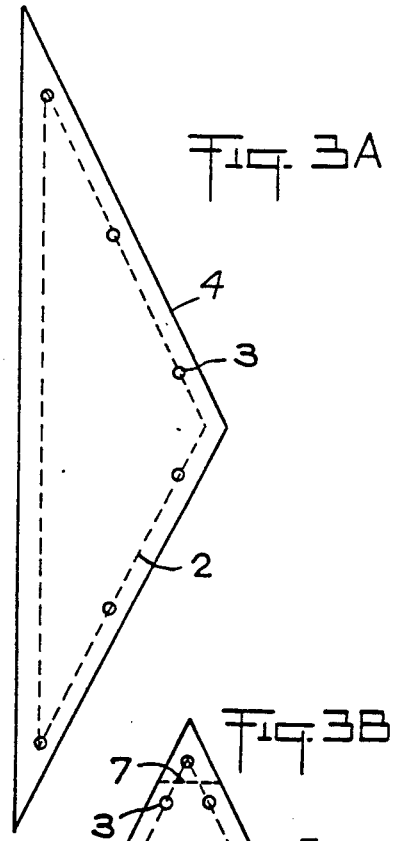
Fig. 3A
4
3
2
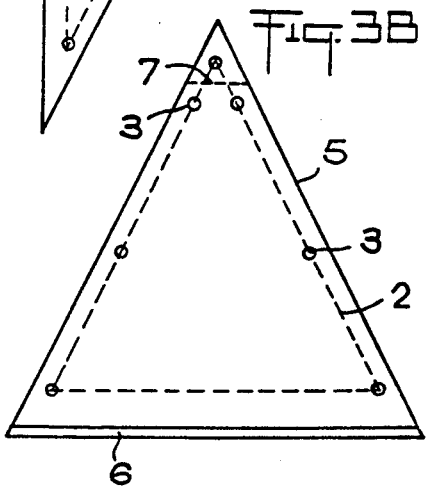
Fig. 3B
7
3
5
3
2
6

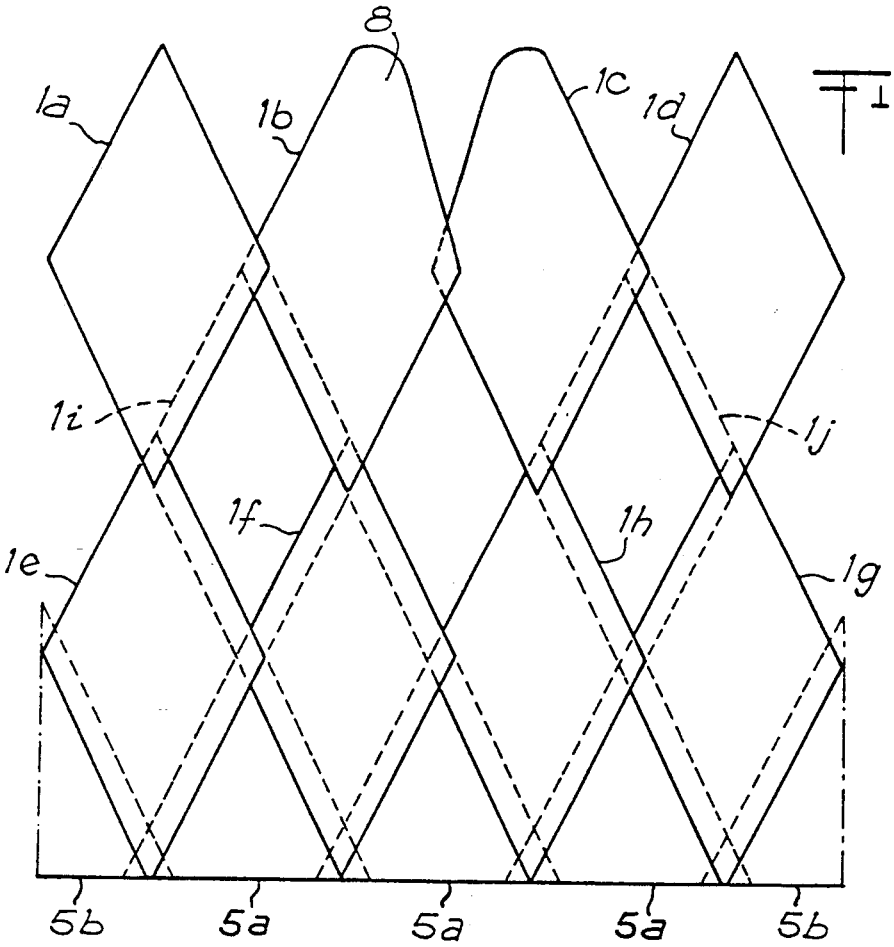
Fig. 4
Fig. 5A
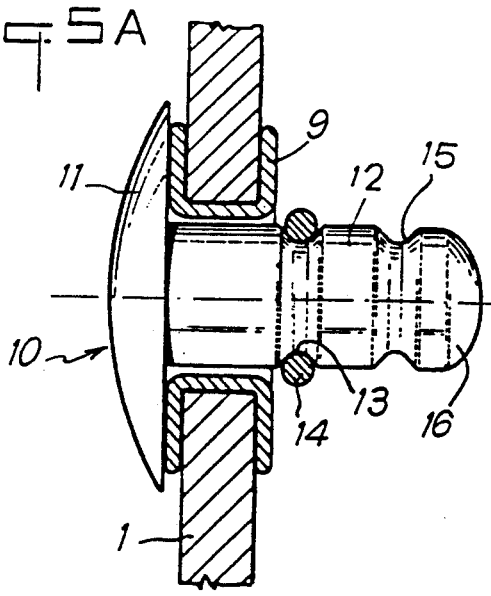
Fig. 5B
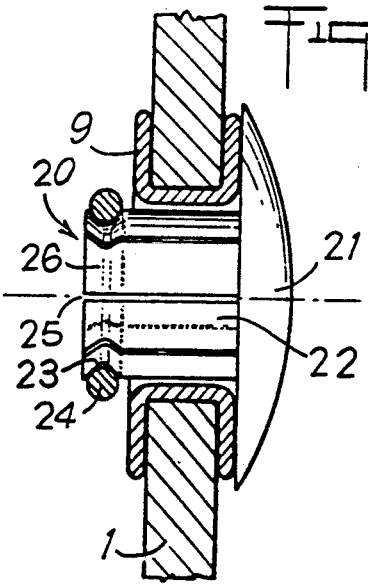

METHOD FOR THE PRODUCTION OF MODULABLE GARMENTS

BACKGROUND OF THE INVENTION

1. Field of the Invention

The invention relates to a method for the production of modulable garments.

2. Prior Art

Conventionally, the production of garments requires a pattern to be made, the pattern being used as a template for cutting each part of the garment. This pattern may be configured to the specific dimensions of the person to whom the garments is destined, as in the case of a "made-to-measure" garment, or it may have standardized dimensions, as in the case of a "ready-made" garment. In both cases, the cutting operation is followed by assembling the different parts of the garment by sewing. This conventional method of assembly presents disadvantages: firstly, the garments produced in this way are not easily transformable; and secondly, since the shape of the parts to be sewn are different and varied, there is an inevitable waste in the basic material used.

It has been proposed to produce transformable or modulable garments from standard elements of various shapes and provided with removable fastening means so that they can be assembled together to make a given garment.

French Patent No. 2 079 865 for example, discloses a method for transforming garments and accessories, using geometrical elements of small dimensions, each element having in common at least one side of the same length. For assembling the different elements, at least one perforation is provided proximate to each top part of the geometrical element, for threading an annular spring therethrough.

French Patent No. 1 563 149 relates to a woman's garment produced by juxtaposition of strips of fabric, leather or the like, assembled together by fasteners, rings or tapes equipped with mutual fastening means.

French Patent No. 2 399 810 discloses a method for the production of garments by assembling separate component parts that can be identical or different.

Finally, U.S. Pat. No. 3,662,404 relates to a garment composed of a very large number of small, diamond-shaped components interconnected by their corners only, whereby a pattern of gaps appears among the lozenges.

However, the above-cited documents disclose either garments of very plain, not really attractive shapes, or garments of more elaborate shapes, but which then require a multiplicity of different elements, resulting in greater fabric storage requirements.

SUMMARY OF THE INVENTION WITH OBJECTS

It is the object of the present invention to provide a method permitting the production of garments which are both attractive and becoming without relying on a plurality of elements of different shapes.

According to the invention, this object is attained by a method for producing a modulable garment by assembling elementary pieces of material; which pieces define a surface comprised of a diamond-shaped contour having a small diagonal and a large diagonal, plus marginal portion outside said diamond-shaped contour, wherein, for each piece, said large diagonal is arranged to be substantially parallel to a principal axis of an intended wearer of said garment and wherein a basic garment is produced by joining together four said pieces so that they fit around a hip or the chest of said wearer, each piece being attached to two neighboring pieces by fastening means substantially at corners of said contours where said small diagonals terminate, said pieces having fastening means located substantially at angles and along sides of said diamond-shaped contour, whereby said contour defines assembling lines.

Advantageously the method also involves additional steps of assembling accessory pieces that define a surface comprised of a triangularly shaped contour of which one side at least is of a same length as a side of said diamond-shaped contour, plus a marginal portion outside said triangularly shaped contour said at least one side of said triangularly shaped contour being attachable to a said basic piece by fastening means, so that assembling of said accessory piece is made to complete said basic garment according to a given design. One side of the triangle may comprise a hem for sliding in a tape.

Those among the pieces constituting the garment which have assembling lines according to the diamond-shaped basic design can themselves be diamond-shaped with edges parallel to the assembling lines. The same may apply to the accessory pieces with assembling lines forming a triangle design constituting a fraction of the diamond-shaped basic design. The edges of the piece are then situated slightly outside the assembling lines so as to obtain a mutual overlapping of the pieces assembled along two respective edges.

As a variant, some at least of the pieces constituting the garment can have a different shape from the diamond- or fraction-of-diamond shape, with one or more edges non-parallel to the assembling lines. Accordingly, one or more pieces constituting the garment can have a free part forming for example a flounce or a flap extending beyond an assembling line, and having no role in the way the garment hangs.

As indicated hereinafter in more details, the choice of a diamond shape as basic design for contours that define the assembling lines of component parts of the garment is not an arbitrary one. It offers many advantages both from a technical and an aesthetic standpoint.

Indeed, the diamond shape is the most rational shape to fit around the body. The diamond-shaped pieces are arranged with one diagonal, preferably the largest, directed vertically. Thus, the sides of the diamond shapes form oblique lines which make it easier to join the parts together while enabling the neck and arm-holes to be more easily defined, thus giving a more becoming aspect to the garment.

Moreover, the fact of choosing four diamond-shaped pieces to form the part of the garment around the chest makes it possible for the neck and the arm-holes of the garment to be formed naturally. In the case of a garment having an upper part and a lower part, the four diamonds forming the part of the garment around the hip then complete the upper part harmoniously.

When the pieces constituting the garment are made of fabric, the sides of the diamond shapes are preferably bias cut into the fabric, that is, cut slantwise relative to the yarns to grant a certain suppleness to the edges and improve cohesion between the assembled pieces.

Advantageously, the dimensions of the diamonds are so selected that the serviceable length of their small diagonal is equal to one quarter of the chest measurement of a standard size and to half the large diagonal. Because of this rationalization of the dimensions of the diamond pieces, a salesman will only need to hold a limited stock of garment parts, corresponding to the standard sizes.

The fastening means are provided on the sides and at the angles of the diamond shapes. Different fastening means can be used such as, for example, buttons, press-studs, laces, . . .

BRIEF DESCRIPTION OF THE DRAWINGS

Other characteristics, details and advantages of the method according to the invention will be more readily understood on reading the following description, with reference to the accompanying drawings, in which:

FIGS. 1A to 1D show the steps of making a finished garment according to the invention, to illustrate the principle on which it is based, FIG. 2 shows a garment part with assembling lines defining a basic diamond-shaped design, used to produce a garment using the method according to the invention, FIGS. 3A and 3B show accessory parts with assembling lines, defining a design that constitutes a fraction of the basic diamond-shaped design, FIG. 4 illustrates a possible way of assembling the parts to form a simple garment using the method according to the invention, and FIGS. 5A and 5B illustrate a press-stud usable for assembling the pieces constituting a garment.

DETAILED DESCRIPTION OF THE PREFERRED EMBODIMENTS

The method for producing modulable garments according to the invention relies on the use of parts having assembling lines which reproduce a single diamond-shaped basic design.

The choice of the diamond shape results from the fact that the human figure fits in a diamond shape L (FIG. 1A) of which the large diagonal is vertical and corresponds substantially to the height of the subject.

As illustrated in FIGS. 1B to 1D, it is possible, to come very close to the body outline, by fractionating the diamond shape L into a juxtaposition of a plurality of equal sized elementary diamond shapes whose large diagonals are also vertical, hence the possibility of producing a garment by assembling pieces according to diamond shapes. In FIG. 1B, the hatched elementary diamonds form the front or the back of the top part of a garment, at chest level, while in FIG. 1C, the hatched elementary diamonds from the front or the back of the lower part of a garment, at hip level. Other elementary diamonds can be use to complete the garment, at least at waist level to form the final garment shown schematically in FIG. 1D.

FIG. 2 illustrates a standard piece 1 with assembling lines 2 reproducing the basic diamond-shaped design. In the illustrated example, piece 1 is itself diamond-shaped, the edges of the diamond being parallel to those of the diamond defined by the lines 2. Piece 1 is made of fabric, leather or other material. Preferably, when the piece is made of fabric, the sides of piece 1 are bias cut in the fabric so that the warp yarns and the weft yarns are parallel to the diagonals of the diamond.

The dimensions of piece 1 are calculated as follows. The small diagonal d of the diamond shape defined by assembling lines 2 is equal to a quarter of the chest or hip measurement of the person for whom the garment is produced. In the case of "ready-to-wear" garments, a number of theoretical diamond shapes are determined, the dimensions of the small diagonals being calculated from the chest or hip measurements corresponding to standard sizes (38N, 40N, . . .). The large diagonal D of the diamond shape defined by assembling lines 2, is chosen to be equal to twice as long as the small diagonal. The dimensions of piece 1 are selected to be slightly greater than those of the diamond shape defined by assembling lines 2 to allow an assembling with a slight overlap of the pieces at the level of their assembled angles or sides. For example, the diagonals of piece 1 have a length which is about 2 cm ($\frac{3}{4}$41) longer than the length of diagonals d and D.

The means for fastening together the pieces constituting the garment (as shown diagrammatically by reference numeral 3) can for example consist of buttons, press-studs or eyelets for threading in laces. One embodiment involving press-studs is described hereinafter with reference to FIG. 5.

The locations of the fastening means along the assembling lines 2 are defined in such a way as to provide for example three fasteners on each side of a diamond: one in the middle of the side and two others at equal distance from said middle, and close to the angles defining the side. In addition, one fastener is provided at each angle of the piece 1.

The main parts of the garment which are formed by the pieces 1 are completed with accessory pieces having assembling lines defining a fraction of the basic diamond-shaped design. Some of these accessory pieces may be obtained by cutting a standard piece 1. For example, FIGS. 3A and 3B show two accessory pieces 4, 5 obtained by cutting piece 1 along its great diagonal and its small diagonal respectively. On two of their sides, the accessory pieces 4, 5 are provided with fastening means 3 disposed in the same way as on the sides of the basic piece 1. The fastening means 3 are situated on assembling lines 2 which define a triangle constituting a fraction of the basic diamond-shaped design.

In the case where the piece is cut along the small diagonal d (FIG. **3*b*), the resulting triangles will advantageously have at least one hem 6** on the base of the triangle. If needs be, the hem can be used as a means for threading in a tape, for tightening the collar, cuffs, waist or a belt, depending on the position of the triangle in the garment.

Moreover, to avoid having an extra thickness of fabric in the overlapping area between the apex of a triangle and the angles of the two adjacent diamonds, the apex of the triangle may be cut as indicated by reference numeral 7 in FIG. 3B. The triangle can then be joined by the two fasteners closest to the removed apex.

FIG. 4 illustrates the two-dimensional form of one embodiment of a garment according to the invention.

A first row of four pieces **1*a* to 1*d* is produced to form the top part of the garment. These pieces have their large diagonal vertical and are assembled by their angles situated at the ends of the small diagonals. A second identical row of four pieces 1*e* to 1*h* is produced to form the bottom part of the garment. The two rows can be joined together by assembling the lower angles of the pieces of the top row with the upper angles of the pieces of the bottom row and/or with interposition of pieces 1*i*, 1*j* at waist level. The resulting garment can be extended downwardly by accessory pieces 5*a*, 5*b***.

As already indicated, the use of a basic diamond-shaped design for the assembling lines of the pieces of the garment bring particular advantages from a practical and aesthetic standpoint.

The oblique lines formed by the sides of the diamond shapes allow the garment to be made with a progressive increase or reduction in its fullness, and affords an impression of slimness.

The presence of joining points between the pieces at the top of oblique lines—as opposed to along horizontal lines—contributes to a trim, flat fastening, i.e. without wrinkles or bulges along the sides of the pieces.

If the pieces 1 are made of fabric, the sides of the diamond shape are advantageously bias cut into the fabric, so as to give suppleness to the assembly and improve cohesion between the pieces.

Moreover, the V-shaped parts formed by the upper sides of the row of pieces 1*a* to 1*d* form a deep neckline and substantial arm-holes, and can thus be attached to a collar and sleeves of appropriate shapes and of free design.

It is finally possible to provide the garment with pockets integrated in a standard element, the dimensions of the element being adequate to this effect.

In another embodiment, the garment is produced by assembling only four basic pieces by their angles situated at the ends of small diagonals in order to form, for example, a blouse or a basic element for bermuda shorts or even for trousers.

A further embodiment consists in assembling pieces on a support provided with fastening means compatible with those provided along the assembling lines forming a diamond shape or a fraction-of-diamond shape. This is suitable for producing a skirt starting from a belt of arbitrary shape or a bodice starting from a neckband.

The foregoing has considered the production of a garment from pieces having a shape that corresponds to that of the diamond-shaped basic design, or of a triangular fraction of that basic design.

The advantages obtained when using a diamond-shaped basic design are preserved if the pieces constituting the garment, or some of those pieces, have a shape other than a diamond or triangle shape, as long as said pieces contain assembling lines that reproduce the diamond shape or part-diamond shape of the basic design, inscribed inside the pieces. Then, when the pieces are assembled, they have free parts lying outside the assembling lines. These free parts play no part in holding the garment together. They constitute for example, flaps, such as shown by reference numeral 8, flounces or other elements for aesthetic purposes.

Assembling of the pieces can be achieved by means of removable press-studs, an example of which is illustrated in FIGS. 5A and 5B.

The press-stud comprises a male part 10 and a female part 20, each passing through respective holes formed in the pieces 1 to be assembled and provided with metallic eyelets 9 crimped on the material (fabric, leather or other material) of the pieces 1. The male part 10 comprises a head 11 extended by a stem 12 that passes through the eyelet 9 and projects therefrom. The projecting portion has a first groove 13 for housing a metallic annular retaining ring 14, and a second groove 15 separating the end 16 of the stem, which has a rounded outline, from the rest of said stem. The female part 20 comprises a head 21 extended by a tubular part 22 at the end of which is formed a groove 23 for a metallic annular retaining ring 24. Longitudinal slots 25 are formed in the tubular part 22 dividing the part into strips 26 extending up to the end of that part, allowing the female part to expand.

During the pressure-assembling of the male and female parts, the end 16 of the male part penetrates into the female part by pushing aside the strips 26, until the ring 24 reaches the level of the groove 15.

The press-studs just described in the foregoing have the advantage of being removable, after removal of the retaining rings, so that they can then be replaced or changed-over in accordance with changes to be made to the garment. In addition, they allow great freedom of assembly of the garment pieces, since they can be assembled on either the front or reverse side, by their top or bottom parts, and through several thicknesses, depending on requirements.

The foregoing description concerned the production of garments for a human being, but the invention also covers the production of garments for different recipients. For example, the invention can be implemented on a reduced scale to produce dolls' clothes. At the other end of the scale, the invention may be used to produce theater costumes for giant-sized models.

We claim:

1. A method for producing a modulable garment comprising the steps of:

providing a plurality of elementary pieces of a material containing a diamond shaped contour with corners at each end of a small diagonal of said diamond shaped contour and corners at each end of a large diagonal of said diamond shaped contour, arranging four of said elementary pieces in side by side relation, with the large diagonals of the contours of said elementary pieces substantially parallel to one another; and joining said four elementary pieces together using fastening means at said corners at each end of said small diagonals of said diamond shaped contour to provide a garment to fit around a hip or chest portion of an intended wearer.

2. The method of claim 1 and further comprising the steps of:

providing a plurality of accessory pieces of a material defined by a triangular shaped contour containing at least one side of a length equal to a length of one of said elementary pieces, and joining at least one of said accessory pieces to said garment using fastening means at said one side of said accessory piece.

3. The method of claim 2 and further comprising the step of providing at least one edge of an accessory piece with a hem for receiving an insertable material therein.

4. The method of claim 1, including: providing each of said elementary pieces with a small diagonal having a length substantially equal to one-fourth of a measurement around said hip or chest and said measurement corresponds to a predetermined garment size.

5. The method of claim 1 including: providing each of said elementary pieces with a large diagonal having a length twice as long as the length of the small diagonal of said elementary piece.

6. The method of claim 1 including:

providing each of said elementary pieces of a fabric material; and cutting an edge of said marginal portions of said fabric material on a bias.

7. The method of claim 1 including: crimping said material of said elementary pieces to form eyelets, providing said fastening means in the form of removable press studs composed of a male part and a female part, providing a male part of said fastening means to eyelets in one of said elementary pieces, and providing a cooperating female part to eyelets in another of said elementary pieces.

8. The method of claim 1 including:

providing said plurality of elementary pieces with a diamond shaped contour having a small diagonal and a large diagonal of a size to provide a garment for a doll.

* * * * *